United States Patent [19]

Baumann

[11] Patent Number: 4,475,574

[45] Date of Patent: Oct. 9, 1984

[54] MOVABLE INTERMEDIATE SUPPORT FOR A WEAVING HEDDLE FRAME

[75] Inventor: Hans Baumann, Horgen, Switzerland

[73] Assignee: Grob & Co. Aktiengesellschaft, Horgen, Switzerland

[21] Appl. No.: 426,880

[22] Filed: Sep. 29, 1982

[30] Foreign Application Priority Data

Jan. 22, 1982 [DE] Fed. Rep. of Germany ..... 3202006

[51] Int. Cl.[3] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 1,155,736 | 10/1915 | Kaufmann . | |
| 1,359,252 | 11/1920 | Kaufmann . | |
| 1,701,520 | 2/1928 | Walker . | |
| 2,033,359 | 3/1936 | Spencer . | |
| 2,037,381 | 4/1936 | Kaufmann . | |
| 2,113,154 | 6/1937 | Kelly . | |
| 2,182,914 | 12/1939 | Coddington . | |
| 2,827,079 | 3/1958 | Kaufmann . | |
| 3,837,365 | 9/1974 | Filter | 139/92 |
| 4,112,980 | 9/1978 | Bader | 139/92 |

FOREIGN PATENT DOCUMENTS

| | | | |
|---|---|---|---|
| 1147539 | 4/1963 | Fed. Rep. of Germany | 139/92 |
| 1294559 | 4/1962 | France | 139/92 |
| 231477 | 6/1944 | Switzerland . | |
| 342533 | 12/1959 | Switzerland . | |
| 371413 | 9/1963 | Switzerland . | |
| 705494 | 3/1954 | United Kingdom . | |

*Primary Examiner*—Henry Jaudon

*Attorney, Agent, or Firm*—Watson, Cole, Grindle & Watson

[57] ABSTRACT

An intermediate support in engagement with heddle carrying rods of a weaving heddle frame includes a body member having end loops at opposite ends for engagement with the rods, at least the body being of vibration absorbing material, and the end loops engaging the rods but without being fixedly secured thereto. The end loops are spaced apart for maintaining a constant spacing of the rods, and the intermediate support is capable of being laterally shifted along the rods to accommodate the positioning of the weaving heddles therealong.

2 Claims, 8 Drawing Figures

11
4
1
6
3

1
4
H
3

11
4
8
10
9

12
13
14
1
3

6
2
5
5
H
2

23
27
19
28
25
26
24
21
20
22
34
33
31
36
38
30
41
39
40
37
32
35

MOVABLE INTERMEDIATE SUPPORT FOR A WEAVING HEDDLE FRAME

BACKGROUND OF THE INVENTION

This invention relates generally to a weaving heddle frame having upper and lower frame staves including parallel heddle carrying rods, end vertical and support members respectively interconnecting opposite ends of the frame staves together. More particularly, the invention relates to the provision of an intermediate support member lying between the end support members and parallel thereto and engaging the rods.

For long weaving widths the corresponding weaving frames must have long frame staves so that it becomes necessary to dispose between the upper and lower frame staves, at a distance from the ends of the staves, an intermediate support or several intermediate supports lying parallel to the stave end supports and being spaced apart suitable distances over the length of the staves, the intermediate support or supports functioning to counteract the tendency of the frame staves to bend while operating the frame. Excessive vibrations of the heddle frames can thereby be prevented. The extent of bending of the frame staves depends on their length and cross-section, the number of weaving heddles engaging the heddle carrying rods, as well as upon the tension of the warp ends. The bending of the frame staves must be maintained as slight as possible so that the distance between the upper and lower frame staves and thereby the distance between the heddle carrying rods, for the purpose of lining up the weaving heddles, can be maintained constant so as to permit a free and unobstructed shifting of the weaving heddles on the heddle carrying rods during operation, and so as to avoid breakage of the weaving heddles.

In order to maintain the distance between the frame staves, and the heddle carrying rods thereon, as constant as possible, various shapes and types of intermediate supports have been utilized. Such supports are either fixedly mounted or are interchangeably mounted on the frame staves by means of threaded fasteners or clamping devices. These or other types of securing means have likewise been employed for holding the heddle carrying rods as they extend into transverse slots therein, or comprise projections and recesses between the intermediate supports and the rods which are fitted together. And, the heddle carrying rods may be maintained by rod holders at predetermined distances on the frame staves. The exchangeable fittings for the intermediate supports permit a change of position thereof between the weaving heddles in the course of the weaving process. However, the weaving heddles take their final position only after commencement of the weaving process, so that a stationary fixed intermediate support in a heddle frame may therefore need to be shifted from its initial position and thereafter fixed in place after the start of the weaving process.

The use of such types of intermediate supports is disadvantageous in that the insertion thereof when anchored in one of the frame staves is quite time consuming and laborious, considering that for example an intermediate support must be inserted and fixed by means of threaded fasteners or the like extending edgewise through the frame staves, or must be fixed by means of special clamping devices thereby requiring special tools.

SUMMARY OF THE INVENTION

The aforementioned disadvantages are avoided by the present invention which includes the provision of an intermediate support which is capable of being located at any desirable position along the length of the frame staves and which engages the heddle carrying rods in a positive manner but without the need for special tools otherwise required for insertion and removal of the intermediate supports, but which prevents vibration of the heddle frame and maintains a constant distance between the heddle carrying rods. The intermediate support member of the invention comprises a body member having end loops at opposite ends with at least the body member being of vibration absorbing material. The end loops respectively engage the heddle carrying rods without being fixedly secured thereto, and the end loops are spaced apart for maintaining a constant spacing of the rods. The intermediate support member is thus capable of being adjustably shifted along the heddle carrying rods to accommodate the positioning of the weaving heddles therealong.

DETAILED DESCRIPTION OF THE INVENTION

Figures 1, 2, 3, 4:
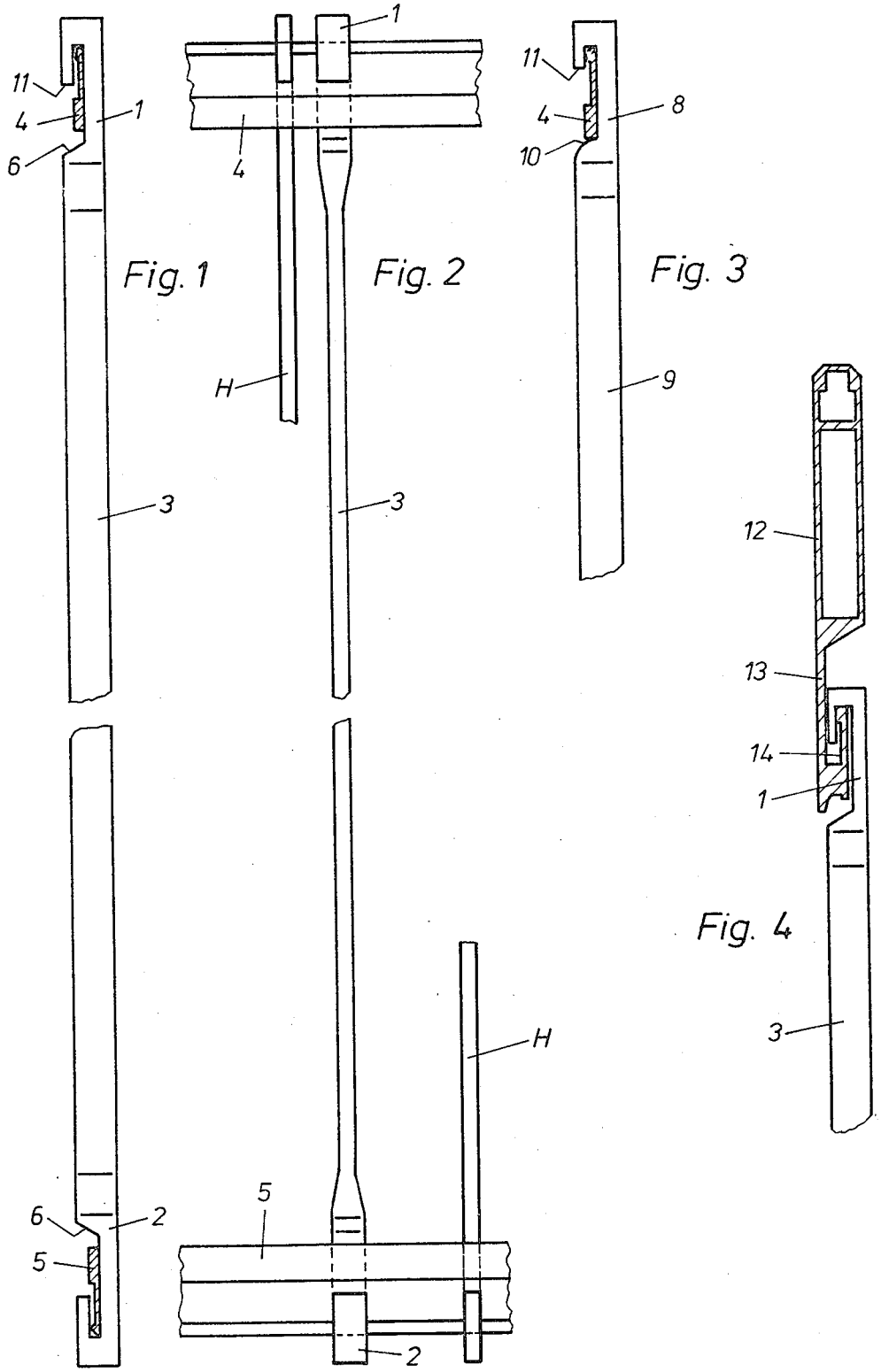
FIGS. 1 and 2 are, respectively, side and front elevational views of one embodiment of an intermediate support member according to the invention, as shown in engagement with heddle carrying rods of upper and lower frame staves.
FIG. 3 is a side view showing, in part, a variant of the FIG. 1 intermediate support at the upper loop end thereof.
FIG. 4 is a sectional view taken through a frame stave illustrating a heddle carrying rod as integral therewith and with which the intermediate support of FIG. 1 is engaged.

Turning now to the drawings wherein like reference characters refer to like and corresponding parts throughout the several views, upper and lower end loops 1 and 2 of an intermediate support member are integrally formed with a body member 3 thereof made of vibration absorbing material as are the end loops, such material preferably being polyurethane. The end loops engage heddle carrying rods 4 and 5 by being hooked thereover, and are designed to permit vertical play between the inner confronting edges of the heddle carrying rods and edges 6 of the end loops which slope inwardly toward one another. The intermediate support can therefore be easily inserted onto the heddle carrying rods, but can only transmit tensile forces between the rods.

A modification of the intermediate support member is illustrated in FIG. 3, wherein end loops 8 (only one of which is shown) are integrally formed with body member 9 and are together with the body member also made of vibration absorbing material. Here, there is no vertical play between the confronting inner edges of the heddle carrying rods and the adjacent rounded edges 10 of each end loop. Each heddle carrying rod therefore fits precisely in its respective hook opening of the end loop, and leg 11 of the end loop is shorter than that shown in FIG. 1 to facilitate installation of the intermediate support member as these end loops are extended over the outer edges of the heddle carrying rods. In the FIG. 3 embodiment, therefore, the intermediate support member is capable of transmitting tensile as well as compressive forces between the opposing heddle carrying rods. Moreover, it should be made apparent to those having ordinary skill in this art that the heddle carrying rods are mounted in some suitable manner on upper and lower frame staves of a weaving heddle frame, and that a plurality of weaving heddles H (FIG. 2) having hook ends engage the heddle carrying rods as in the normal manner. The upper and lower frame staves have the usual end supports (not shown), and the intermediate support lies parallel thereto. Since the end loops of the intermediate support are also hook shaped and may be shaped similarly to that of the end loops of the weaving heddles except that they are wider than such end loops, the intermediate support can be laterally shifted along the heddle carrying rods so as to accommodate the positioning of the weaving heddles therealong after the commencement of the weaving operation.

The heddle carrying rods can be anchored on the frame staves of the heddle frame with rod holders being spaced along the length of the heddle rods for connecting the rods to the frame staves lying parallel thereto. Otherwise, a frame stave 12 shown in FIG. 4 may be provided with an integral extension 13 and a heddle carrying rod 14 made integral with such extension. Engagement between the intermediate support member and the heddle carrying rods are otherwise the same as described with reference to FIGS. 1 and 2.

Figures 5, 6, 7, 8:
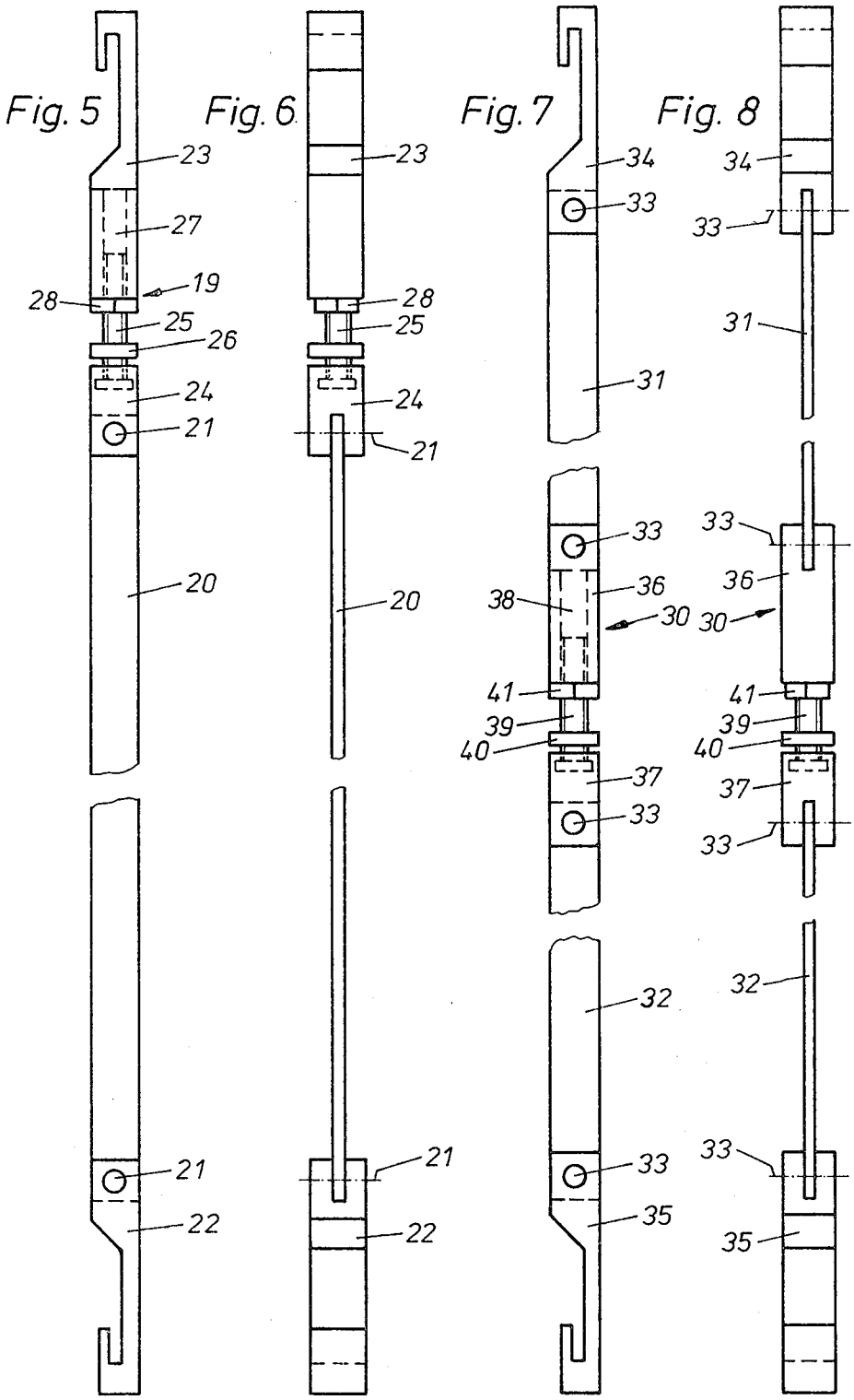
FIGS. 5 and 6 are, respectively, side and front elevational views of an intermediate support of another embodiment according to the invention.
FIGS. 7 and 8 are, respectively, side and end elevational views of still another embodiment of an intermediate support member according to the inventiom.

In the FIGS. 5 and 6 embodiment, body member 20 of vibration absorbing material has a separate end loop 22 fixedly mounted at its lower end by means of a fastener 21, such as a bolt, rivet, or the like. A similar fastener 21 is employed to mount end loop 23 to the opposite end of the body member via a tensioning device 19. This device comprises a support bracket 24 having a countersunk recess within which the head of a threaded pin 25 engages to permit pin rotation about only its central axis. The pin has a disc 26 affixed thereto, and the pin engages an internally threaded bore 27 provided in end loop 23. Rotation of the pin about its central axis, upon manual manipulation of disc 26, therefore adjusts the distance between the end loops. And, a locking nut 28 in engagement with the threads of the pin and in abutment against the inner face of end loop 23 functions to lock the adjusted spacing of end loop 23 relative to body member 20. It is thus possible to reduce the distance a predetermined amount between end loops 22 and 23 after they have been hooked over the heddle carrying rods.

A further embodiment is illustrated in FIGS. 7 and 8 wherein the support member comprises a pair of body elements 31 and 32 of vibration absorbing material interconnected at the inner ends thereof by a tensioning device 30. End loops 34 and 35 are affixed to respective outer ends of body elements 31 and 32 by means of fasteners 33, which are similar to fasteners 21. And, tensioning device 30 is similar to tensioning device 19 in that it comprises a support bracket 37 affixed to element 32 by a fastener 33 and having a countersunk recess for the reception of the head of a threaded pin element 39 to facilitate rotation of the pin about its central axis. A disc 40 is affixed to the pin member for manually rotating same, and the pin extends into a threaded bore 38 provided in a support member 36 affixed to body element 31 by means of a fastener 33. And, a locking nut 41 functions in the same manner as locking nut 28 to lock the pin in place after adjustment.

Obviously, many other modifications and variations of the present invention are made possible in the light of the above teachings. It is therefore to be understood that within the scope of the appended claims the invention may be practiced otherwise than as specifically described.

What is claimed is:

1. In a weaving heddle frame having upper and lower frame staves including parallel heddle carrying rods vertically spaced a predetermined distance apart, vertical end support members respectively interconnecting opposite ends of said frame staves together, a plurality of weaving heddles having hooked ends respectively engaging said rods, and at least one intermediate support member lying between said end support members and parallel thereto and having recessed opposite ends engaging said rods, the improvement wherein said intermediate support member is solely of vibration absorbing material and comprises a body member integrally formed with hooked ends forming end loops at said opposite ends thereof, said vibration absorbing material being flexible so as to render the hooked ends capable of being placed into position for engaging said rods by being hooked over said rods, whereby said intermediate support member when in position transmits tensile forces between the rods.

2. In the weaving heddle frame according to claim 1, wherein said vibration absorbing material comprises polyurethane.

* * * * *